US006671488B2

(12) United States Patent
Izawa et al.

(10) Patent No.: US 6,671,488 B2
(45) Date of Patent: Dec. 30, 2003

(54) IMAGE HEATING APPARATUS

(75) Inventors: Satoru Izawa, Shizuoka-ken (JP); Masao Amano, Susono (JP); Hiroshi Kataoka, Shizuoka-ken (JP); Eiji Uekawa, Shizuoka-ken (JP); Fumiki Inui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/076,478

(22) Filed: Feb. 19, 2002

(65) Prior Publication Data

US 2002/0168202 A1 Nov. 14, 2002

(30) Foreign Application Priority Data

Feb. 20, 2001 (JP) ..... 2001/043221
Feb. 1, 2002 (JP) ..... 2002/025264

(51) Int. Cl.[7] ..... G03G 15/20

(52) U.S. Cl. ..... 399/329; 219/216; 399/122; 399/328; 399/330

(58) Field of Search ..... 219/216, 619; 399/320, 328, 329, 330, 333, 122

(56) References Cited

U.S. PATENT DOCUMENTS

| | | | | |
|---|---|---|---|---|
| 4,970,219 A | | 11/1990 | Effland et al. | 514/339 |
| 5,149,941 A | | 9/1992 | Hirabayashi et al. | 219/216 |
| 5,210,579 A | | 5/1993 | Setoriyama et al. | 355/285 |
| 5,450,181 A | | 9/1995 | Tsukida et al. | 355/282 |
| 5,525,775 A | | 6/1996 | Setoriyama et al. | 219/216 |
| 5,722,026 A | | 2/1998 | Goto et al. | 399/333 |
| 5,819,150 A | * | 10/1998 | Hayasaki et al. | 399/330 |
| 5,860,051 A | | 1/1999 | Goto et al. | 399/529 |
| 5,904,871 A | | 5/1999 | Sakai et al. | 219/216 |
| 6,002,106 A | | 12/1999 | Kataoka et al. | 219/216 |
| 6,072,964 A | | 6/2000 | Abe et al. | 399/69 |
| 6,298,213 B1 | | 10/2001 | Miyamoto et al. | 399/320 |

FOREIGN PATENT DOCUMENTS

| | | |
|---|---|---|
| JP | 63-313182 | 12/1988 |
| JP | 02-157878 | 6/1990 |
| JP | 4-44075 | 2/1992 |
| JP | 04-204980 | 7/1992 |
| JP | 7-295411 | 11/1995 |
| JP | 2002-347529 | 12/2000 |

* cited by examiner

*Primary Examiner*—Hoang Ngo
(74) *Attorney, Agent, or Firm*—Fitzpatrick, Cella, Harper & Scinto

(57) ABSTRACT

An image heating apparatus includes a rotatable member contactable to a recording material carrying an image; a regulating member for regulating a movement of rotatable member in the direction of a generating line of rotatable member; wherein the regulating member is fixed so as not to rotate and has a surface opposed to an outer surface of an end portion of the rotatable member.

32 Claims, 11 Drawing Sheets

IMAGE HEATING APPARATUS

FIELD OF THE INVENTION AND RELATED ART

The present invention relates to an image heating apparatus such as a thermal fixing device mounted in an image forming apparatus, for example, a copying machine or a printer. In particular, it relates to an image heating apparatus having a rotational member, which contacts a recording medium on which an image is borne, and a regulating member for regulating the movement of the rotational member in the direction parallel to its generatrix direction.

In the image forming portion of an image forming apparatus which employs an image formation process, for example, an electrophotographic process and an electrostatic recording process, an unfixed toner image in accordance with the image formation information for an intended image is directly formed on, or transferred onto, a recording medium (transfer medium, printing paper, photosensitive paper, electrostatic recording paper, and the like). This unfixed toner image on the recording medium is thermally fixed to the recording medium by a thermal fixing apparatus; in other words, the unfixed image is turned into a permanent image by a thermal fixing apparatus. As for a thermal fixing apparatus, a heating apparatus employing the so-called roller heating method is widely used. A roller heating type thermal fixing apparatus comprises a heat roller (fixing roller) as a heating member, and a pressure roller as a pressure applying member. The two rollers are rotated while kept pressed against each other, by the application of a predetermined amount of pressure. In operation, while a recording medium bearing an unfixed toner image is conveyed through the nip formed between the heat and pressure rollers, the unfixed image is fixed to the recording medium; it is turned into a permanent image.

In recent years, due to the concerns regarding "quick start" and energy conservation, a film heating type heating apparatus has been put to practical use, which has been disclosed in, for example; Japanese Laid-open Patent Applications 63-313182, 2-157878, 4-44075, and 4-204980.

A film heating type heating apparatus comprises: a heating member, for example, a ceramic heater; a pressure roller as a pressure applying member; and a heat resistant resin film (which hereinafter will be referred to as fixation film). The pressure roller is kept pressed against the heating member, forming a compression nip (which hereinafter will be referred to as fixation nip). In operation, a recording medium bearing an unfixed toner image is introduced into the fixation nip, and conveyed through the fixation nip, together with the fixation film, with the recording medium pinched between the fixation film and pressure roller, while the heating member, or the ceramic heater, conducts heat to the recording medium through the fixation film. As a result, the unfixed image on the recording medium is fixed to the surface of the recording medium, by the heat and compressive force in the fixation nip.

A film heating type heating apparatus is capable of becoming ready to heat by the time a recording medium reaches the heating apparatus, even if power begins to be supplied to the heater after the reception of a print signal by the image forming apparatus. In other words, while a film heating type heating apparatus is kept on standby, the heater of a film heating type heating apparatus does not need to be supplied with power. Thus, from the standpoint of energy conservation, a film heating type heating apparatus is an excellent thermal fixing apparatus in that it does not waste energy.

Replacing the resin fixation film, as a heating member, of a film heating type heating apparatus, with a thin metallic sleeve, the base layer of which is formed of a metal superior in thermal conductivity to the resin fixation film, improves the fixation performance of the fixing apparatus, enabling the fixing apparatus to satisfactorily cope with the increase in the speed of an image forming apparatus.

The fixation film, or sleeve, tends to shift in the thrust direction. Thus, a film heating type heating apparatus in accordance with the prior arts is provided with a regulating member, such as a sleeve end flange, for regulating this shifting of the fixation film in the thrust direction, more specifically, for catching the fixation film by one of its edges. With the provision of this type of structural arrangement, the fixation film which is rotated while being kept in contact with the flat surface of the heater, is repeatedly flexed while one of its edges is remaining in contact with the corresponding sleeve end flange. Eventually, the edge portions of the metallic film develop cracks. This phenomenon is more severe in the case that a metallic sleeve (fixation film formed of thin sheet of metallic material) comprising a base layer formed of metallic material superior in thermal conductivity to resin fixation film, is used as a heating member.

More specifically, as the edge of a fixation film is placed in contact with a sleeve end flange due to the shifting of the fixation film, it is subjected to such force that acts in the direction to increase the diameter of the edge portion of the fixation film, that is, in a manner to expand the edge portion of the fixation film like the end of a trumpet. This force is greater in the case of a metallic fixation film, or sleeve, for the following reason. That is, a metallic sleeve is supported from inside by a flange, being therefore not regulated in terms of its expansion in its radius direction. Thus, its edge portion is more likely to be deformed in the form of the end portion of a trumpet by the above described force. Obviously, the edge of a metallic sleeve rubs against a sleeve end regulation flange as does any fixation film. Therefore, a metallic fixation film (sleeve) is more likely to develop cracks along the edges.

In addition, if the metallic base layer of a metallic sleeve is excessively thick, it takes a long time for the temperature of the heater to be raised to a level at which satisfactory fixation is possible, after a printing operation is initiated at room temperature; it takes too long for the heater temperature to rise to a predetermined level; the waiting time is long.

In other words, if the metallic base layer of a metallic sleeve is excessively thick, it is difficult to reduce the length of the time (first print time) from the reception of a print signal to the completion of the first print.

Further, if a metallic sleeve is thick, it is inferior in elastic deformation which is essential for the metallic sleeve to contact the heater surface, without leaving any gap between the two. Therefore, it is difficult for the heat from the heater to efficiently conduct to the metallic sleeve.

Further, the thicker the metallic sleeve, the higher the pressure which must be applied to ideally place the metallic sleeve in contact with the heater surface. In other words, in the case of a relatively thick metallic sleeve, it must be forcefully bent. Therefore, it does not stand long use; it breaks down due to fatigue.

As will be evident from the above description, a structural arrangement which is capable of making a thin metallic sleeve in accordance with the prior arts, satisfactory in terms of thermal and mechanical strength, has not been found.

As for a method for solving the above described problem, it is possible to provide a metallic sleeve with edge reinforcement members. However, a metallic sleeve must be able to elastically deform in order to conform to the flat heater surface, and it has been virtually impossible to form an edge reinforcement member which does not interfere with the elastic deformation of a metallic sleeve, which is necessary for the metallic sleeve to conform to the flat heater surface. More specifically, when an edge reinforcement member is secured to the edge of a metallic sleeve by gluing or the like method, it must be able to flex with the metallic sleeve. However, in the case of a film heating type heating apparatus in accordance with the prior arts, in which the metallic sleeve is in contact with the flat heater surface from one end of the heater to the other in terms of the lengthwise direction of the heater, if a part of the edge reinforcement member is on the inward surface of the metallic sleeve, it comes into contact (interferes) with the heater surface, resulting in the frictional damage to the edge reinforcement member and/or heater surface.

It is also possible to make such a structural arrangement that the portions of the heater surface correspondent in position to the edge portions of a metallic sleeve, that is, the portions fitted with an edge portion reinforcement member, are kept away from the inward surface of the metallic sleeve, in order to prevent the above described problem. However, it is extremely difficult to process a heater, in particular, a thin ceramic heater with a fixed thermal capacity in order to give it such a structure. Also, it is extremely costly. In other words, the idea is not practical. Further, from the standpoint of the reliability of current flow, it is extremely difficult to provide the electrically conductive portion of a heating member, or the like, on a substrate, with areas which are not level with the other portion of the conductive portion.

As will be evident from the above, it is difficult to realize a thermal fixing apparatus which employs a metallic sleeve, is satisfactory in fixing performance, and also is durable. So far, a means for realizing such a thermal fixing apparatus has not been provided.

SUMMARY OF THE INVENTION

The present invention was made in consideration of the above described problem. Thus, its primary object is to provide an image heating apparatus superior in the durability of its rotational member.

Another object of the present invention is to provide an image heating apparatus which is compact in the measurement in terms of the direction parallel to its generatrix direction.

According to an aspect of the present invention, an image heating apparatus comprises:

a rotational member which contacts an image bearing recording medium;

a regulating member for regulating the movement of said rotational member in the direction parallel to the direction of the generatrix of the rotational member;

wherein said regulating member is secured so that it does not rotate, and is provided with a surface which faces peripheral surface of the lengthwise end portion of said rotational member.

According to another aspect of the present invention, an image heating apparatus comprises:

a rotational member which contacts an image bearing recording medium;

a first regulating member for regulating the movement of said rotational member in the direction parallel to the direction of the generatrix of the rotational member, said first regulating member being enabled to rotate following the rotation of said rotational member; and a second regulating member for regulating the movement of the said first regulating member in the direction parallel to the generatrix direction, said second regulating member being nonrotationally secured;

wherein said first regulating member is in the form of a cylindrical ring, and said second regulating member is shaped like a "cylindrical" pillar with a missing segment.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

<Embodiment 1>

(1) Example of Image Forming Apparatus

Figure 1:
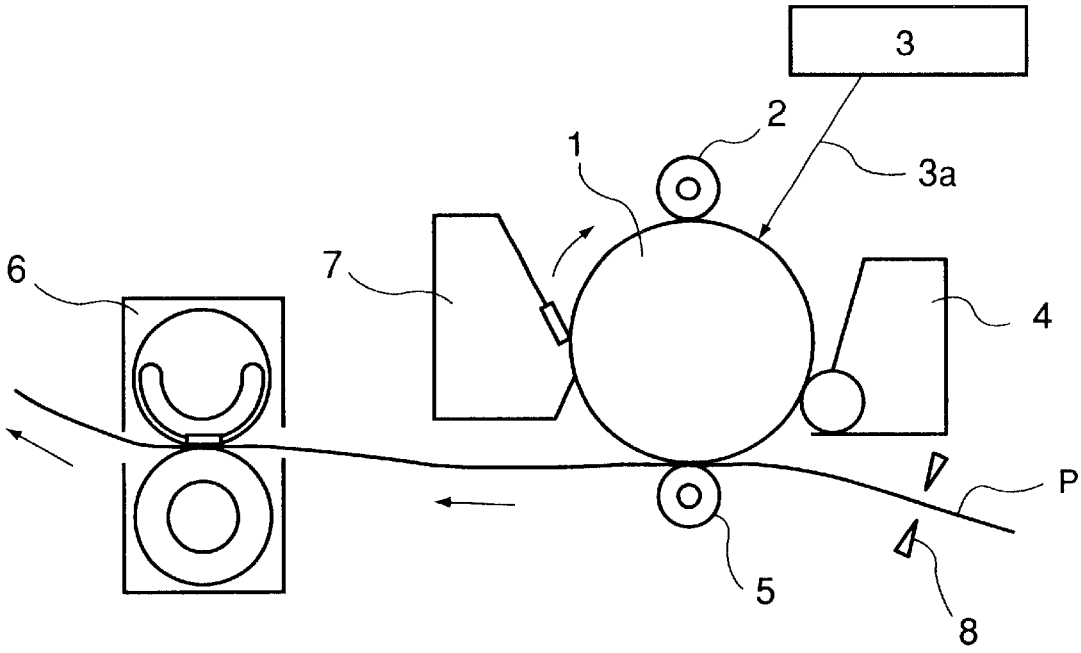
FIG. 1 is a schematic sectional view of the image forming apparatus in the first embodiment of the present invention, and shows the structure thereof.

FIG. 1 is a schematic sectional view of an example of an image forming apparatus, for showing the general structure thereof. The image forming apparatus in this embodiment is a transfer type laser beam printer which employs an electrophotographic image formation process.

A referential code 1 designates a photoconductive drum, which comprises a cylindrical base formed of aluminum or nickel, and a layer of photoconductive substance such as OPC, amorphous selenium, amorphous silicon, or the like, formed on the peripheral surface of the cylindrical base.

The photoconductive drum 1 is rotationally driven at a predetermined peripheral velocity in the clockwise direction indicated by an arrow mark. As it is rotated, first, its peripheral surface is uniformly charged to predetermined polarity and potential level by a charge roller 2 as a charging apparatus.

Next, the uniformly charged peripheral surface of the photoconductive drum 1 is exposed to a laser beam 3*a,* which is emitted in a manner to scan the peripheral surface of the photoconductive drum 1, from a laser scanner 3 while being turned on or off in accordance with the image formation data. As a result, an electrostatic latent image is formed on the peripheral surface of the photoconductive drum 1.

This electrostatic latent image is developed (visualized) into a toner image by a developing apparatus. As for the method for developing an electrostatic latent image, there are the jumping developing method, two-component developing method, FEED developing method, and the like. In many cases, these developing methods are used as means for developing, in reverse, an electrostatic latent image formed by exposure.

A toner image, or a visual image, is transferred by a transfer roller 5, as a transferring apparatus, from the photoconductive drum 1 onto a recording medium P, which is delivered, with a predetermined timing, to the transfer station.

More concretely, in order to align the theoretical line on the peripheral surface of the photoconductive drum 1, from which the formation of a latent image begins, with the theoretical line on the recording medium P, which will coincide with the leading edge of a toner image, in terms of the recording medium conveyance direction, after the transfer of the toner image onto the recording medium P, the arrival of the leading edge of the recording medium P is detected by a sensor 8. After being delivered to the transfer station with the predetermined timing, the recording medium P is conveyed through the transfer station, while being sandwiched by the peripheral surfaces of the photoconductive drum 1 and transfer roller 5.

After the transfer of the toner image onto the recording medium P, the recording medium P is conveyed to a thermal fixing apparatus 6, in which the toner image is thermally fixed to the recording medium P; the toner image is turned into a permanent image.

Meanwhile, the residual toner particles, that is, the toner particles remaining on the peripheral surface of the photoconductive drum 1 after the toner image transfer, are removed from the peripheral surface of the photoconductive drum 1 by a cleaning apparatus.

(2) Thermal Fixing Apparatus 6

Figure 2:
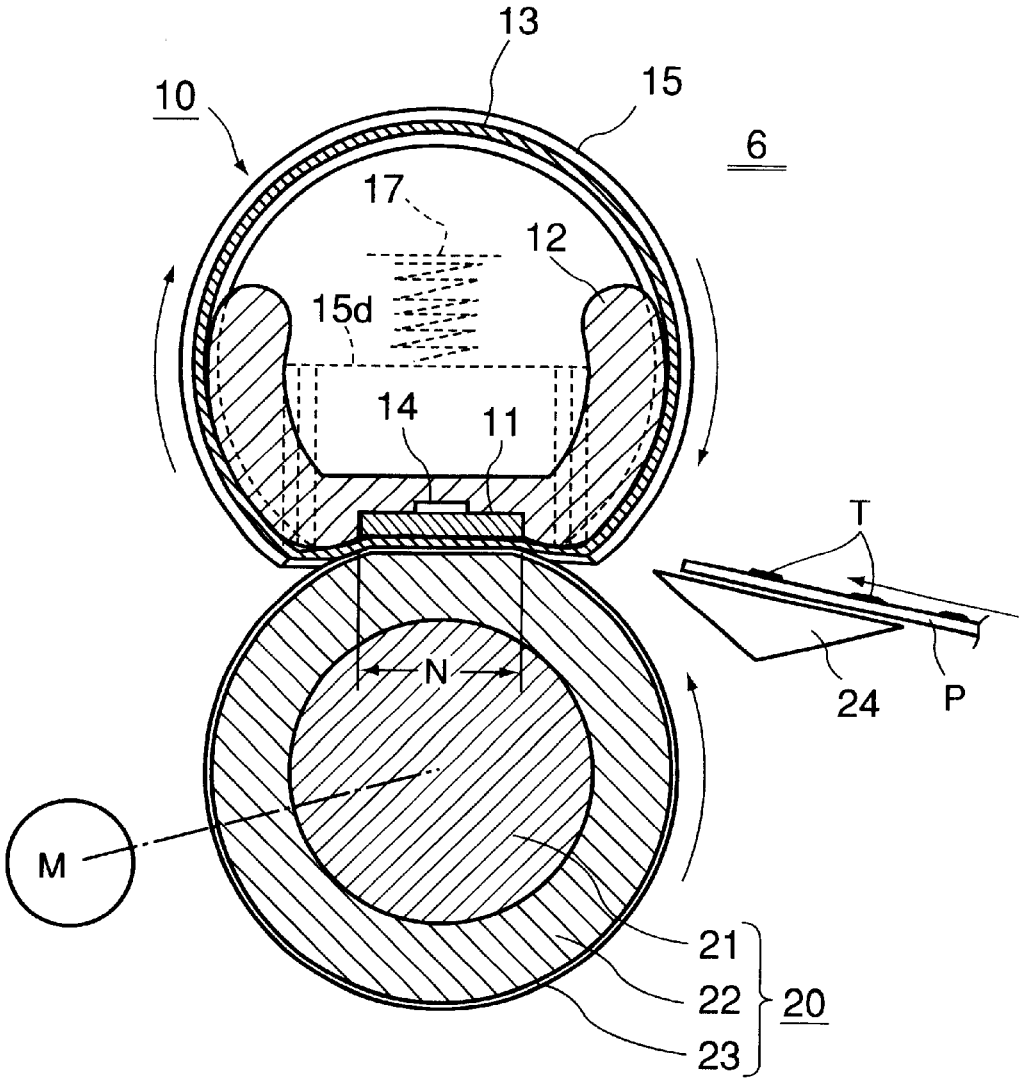
FIG. 2 is a schematic sectional view of the thermal fixing apparatus in the first embodiment of the present invention.
Figure 3:
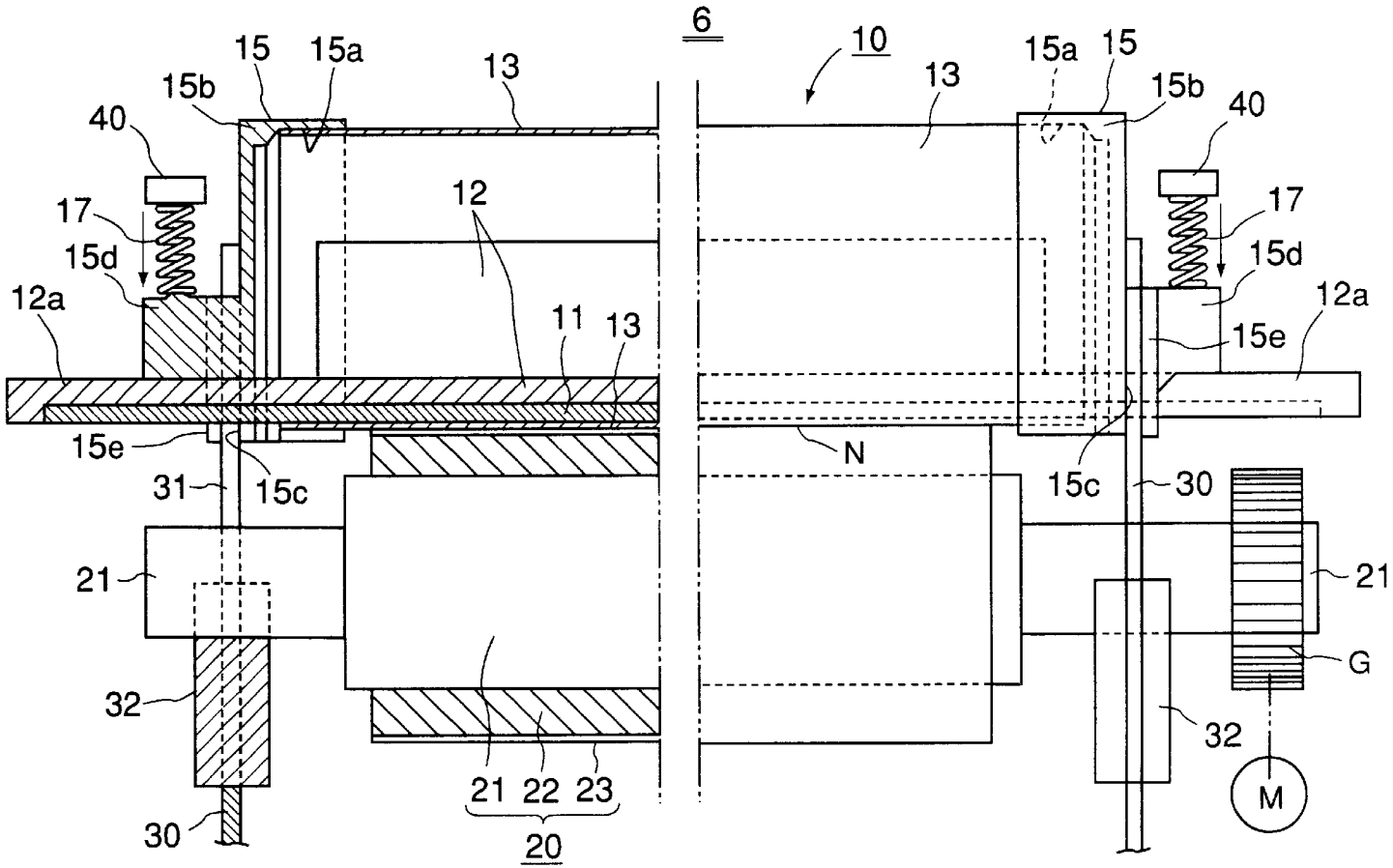
FIG. 3 is a schematic front view of the thermal fixing apparatus in the first embodiment of the present invention, in which certain portions have been intentionally left out to show the interior thereof.

FIG. 2 is a sectional view of the thermal fixing apparatus 6, at a plane perpendicular to the lengthwise direction of the apparatus 6. FIG. 3 is a schematic front view of the thermal fixing apparatus 6, in which certain portions have been intentionally left out in order to show the interior thereof.

Designated by a referential code 10 is a fixing member (heater assembly) as a heating member, and designated by a referential code 20 is an elastic pressure roller as a pressure applying member. The fixing member 10 and pressure roller 20 are disposed so that their peripheral surfaces are kept pressed against each other, forming a nip, or a fixation nip N, in which a recording medium is heated.

The fixing member 10 comprises a heater 11 as a heating member, a thermally nonconductive stay/holder 12, a metallic sleeve 13 (fixation sleeve), a sleeve end protection cap 15, and the like.

The heater 11 is secured to the bottom surface of the thermal nonconductive stay/holder 12. The metallic sleeve 13 is loosely fitted around the thermally nonconductive stay/holder 12. The protective cap 15 is fitted around the lengthwise end of the thermally nonconductive stay/holder 12, to regulate the edge of the metallic sleeve 13 (both edges of the metallic sleeve 13 are fitted a pair of the protective caps 15, one for one). In other words, the protective cap 15 is a regulating member for regulating the movement of the metallic sleeve 13 in its lengthwise direction.

The elastic pressure roller 20 as a pressure applying member is made up of a metallic core 21, and an elastic layer 22 formed of heat resistant rubber, for example, silicon rubber and fluorinated rubber, or foamed silicon rubber, around the peripheral surface of the metallic core 21. It may also be provided with a releasing layer 23 formed of PFA, PTFE, FEP, or the like, which is coated over the elastic layer 22.

Figure 4:
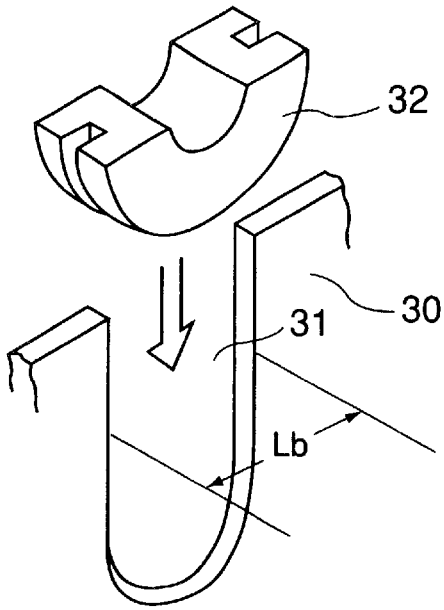
FIG. 4 is a perspective view of the bearing, and the recess in the side wall of the boxy frame of the fixing apparatus, in which the bearing is fitted.

Designated by a referential code 30 are the front and rear walls of the boxy frame of the fixing apparatus. The pressure roller 20 and fixing member 10 are placed in the boxy frame, being held between these walls 30. More specifically, each of the front and rear walls 30 of the boxy frame is provided with a recess (FIGS. 4 and 5) with a width of Lb, the deepest end of which is fitted with a bearing 32 formed of heat resistant resin such as PEEK, PPS, liquid crystal polymer, or the like. The pressure roller 20 is rotationally borne by the bearing 32, with the end portion of the metallic core 21 of the pressure roller 20 fitted in the groove of the bearing 32.

As will be described later, the fixing member 10 is disposed between the front and rear walls 30 of the boxy frame, being located on the top side of the pressure roller, with the lengthwise outward end portions 15*c* of the protective caps 15 fitted in the grooves 31 of the front and rear walls 30 of the boxy frame, one for one.

Further, at each longitudinal end of the fixing member 10, a compression spring 17 is disposed in the compressed state between the spring seat portion 15*d* of the protective cap 15, and a stationary spring seat 40. The resiliency of the compression springs 17 generates a predetermined amount of pressure, keeping the fixing member 10 pressed upon the peripheral surface of the pressure roller 20, on the top side, against the elasticity of the metallic sleeve 13 and the elasticity of the pressure roller 20. Therefore, a nip, or the fixation nip N, with a predetermined width, is formed and maintained between the pressure roller 20 and the fixing member 10. In the fixation nip N, in which the fixing member 10 and pressure roller 20 are kept pressed against each other, the metallic sleeve 13 is sandwiched between the heater 11 and elastic pressure roller 20, being deformed in a manner to conform to the flat bottom surface of the heater 11, with the inward surface of the metallic sleeve 13, in terms of the radius direction of the metallic sleeve 13, contacting the flat bottom surface of the heater 11, with no gap between the two surfaces.

Designated by a referential code G is a drive gear attached to one of the lengthwise ends of the metallic core 21 of the pressure roller 20. As the driving force from a driving portion M is transmitted to this driving gear G, the pressure roller 20 is rotationally driven in the counterclockwise direction indicated by an arrow mark in FIG. 2, at a predetermined peripheral velocity. As the pressure roller 20 is rotationally driven, friction occurs between the pressure roller 20 and the metallic sleeve 13 of the fixing member 10, in the fixation nip N. As a result, the metallic sleeve 13 is rotationally driven by the friction, in the clockwise direction in FIG. 2, around the thermally nonconductive stay/holder 12, with the internal surface of the metallic sleeve 13 sliding on the bottom surface of the heat 11; the metallic sleeve 13 is driven by the rotation of the pressure roller 20 (pressure roller driving system).

Since the metallic sleeve rotates while sliding on the heater 11 and thermally nonconductive stay/holder 12 within the loop of the metallic sleeve, it is necessary to reduce the friction between the fixation film 13 and the heater 11, and the friction between the fixation film 13 and thermally nonconductive stay/holder 12. For this reason, the bottom surface of the heater 11, and the outwardly facing surface of the thermally nonconductive stay/holder 12, in terms of the radius direction of the fixation film 13, are coated with a small amount of lubricant, such as heat resistant grease or the like, making it possible for the metallic sleeve 13 to smoothly rotate.

The heater 11 heats the fixation nip N, in which a toner image T on the recording medium P is fixed to the recording medium P by being melted.

While the metallic sleeve 13 is rotated by the rotation of the pressure roller 20, and after the heater temperature has been raised to a predetermined level by the power supplied to the heater 11, the recording medium P bearing an unfixed toner image T is conveyed between the metallic sleeve 13 and pressure roller 20, in the fixation nip N, being guided by the fixing apparatus entrance guide 24. While the recording medium P is conveyed through the fixation nip N, the unfixed toner image T on the recording medium P is fixed to the recording medium P by being heated by the heat from the heater 11, through the metallic sleeve 13. After passing through the fixation nip N, the recording medium P separates from the peripheral surface of the metallic sleeve 13, and is discharged into an unshown delivery tray, being guided by an unshown heat resistant exit guide of the fixing apparatus.

a) Metallic Sleeve 13

The metallic sleeve 13 is a sleeve with a small thermal capacity. In order to enable the metallic sleeve 13 to quickly start up, the base layer of the metallic sleeve 13 is formed of heat resistant and highly thermally conductive metallic substance, such as aluminum, nickel, copper, zinc, or the like, or metallic alloy, such as stainless steel, or the alloys of the preceding metals. The overall thickness of the metallic sleeve 13 is made to be no more than 200 $\mu$m. On the other hand, in order to make the metallic sleeve 13 strong and durable enough to realize a durable thermal fixing apparatus, the overall thickness of the metallic sleeve 13 needs to be no less than 30 $\mu$m. Thus, the overall thickness of the metallic sleeve 13 is desired to be no less than 30 $\mu$m and no more than 200 $\mu$m.

In addition, in order to prevent offset and to ensure that recording medium is properly released from the peripheral surface of the metallic sleeve 13, the metallic sleeve 13 is provided with a surface layer formed of heat resistant resin superior in releasing properties, such as fluorinated resin or silicon resin. As for the examples of fluorinated resin, there are PTFE (polytetrafluoroethylene), PFA (copolymer of tetrafluoroethylene and perfluoroalkyl vinyl ether), FEP (copolymer of tetrafluoroethylene and hexafluoropropylene), FTFE (copolymer of ethylene and tetrafluoroethylene), CTFE (polychlorotrifluoroethylene), and PVDF (polyvinylidene fluoride). The surface layer may be formed of the mixture of the above listed resins. As for the coating method, first, the external surface of the base member of the metallic sleeve 13 is etched, and then, is painted with one of the aforementioned resins to formed the releasing layer, by dipping, power spray, or the like method. Instead of coating, a tube formed of one of the aforementioned resins may be slipped over the base member of the metallic sleeve 13. Further, after blasting the external surface of the metallic base member, the releasing layer may be placed thereon by painting, after the base member is painted with primer, that is, adhesive.

Further, the internal surface of the metallic sleeve 13, which makes contact with the heater 11, may be covered with a layer of highly lubricous substance such as fluorinated resin, polyimide, polyamide, or the like.

b) Heater 1

The heater 11 heats the fixation nip N, in which the toner image T on the recording medium P is permanently fixed to the recording medium P by being melted. It generates heat as electrical current is flowed through it. It comprises a substrate, and a layer of heat generating conductor. The substrate is formed of electrically highly insulative ceramic such as alumina, aluminum nitride, or the like, or formed of heat resistant resin such as liquid crystal polymer or the like. The heat generating layer is coated on the surface of the heat resistant substrate, and is formed of heat generating conductor such as Ag/Pd (silver/palladium alloy), $RuO_2$, $Ta_2N$, or the like, by screen printing or the like method. It is approximately 10 $\mu$m in thickness, and approximately 1–5 mm in width.

The heater 11 may be a metallic heater comprising a metallic substrate, an insulative layer, and a heat generating conductor layer, wherein the insulative layer and heat generating layer are placed in layers on the surface of the metallic substrate, on the side opposite to where the fixation nip is formed, in the listed order. In this case, the metallic substrate may be incurvated on the fixation nip side.

Electric power is supplied to the heat generating conductor layer from an unshown power supplying portion, through an unshown connector. On the back side of the heater substrate, a heat detection element 14 such as a thermistor for detecting the temperature of the heater, the temperature of which is increased by the heat generated by the heat generating conductor layer, is disposed. The duty ratio, frequency, and the like, of the voltage applied to the heat generating conductor layer through unshown electrode portions located at the lengthwise ends of the heater, are properly controlled according to the signals from this temperature detection element 14. This is for keeping constant the internal temperature of the fixation nip N so that the heat necessary for fixing the toner image T on the recording medium P is given to the recording medium P. The DC current from the temperature detection element 14 is flowed to an unshown temperature control portion through an unshown connector, with the interposition of an unshown current flowing portion and DC electrodes.

Further, the heat generating conductor layer of the heater 11 is coated, on the fixation nip side, with a thin protective layer formed of glass, fluorinated resin, or the like substance, in order to make the layer resistant to the rubbing by the metallic film.

Incidentally, when aluminum nitride, or the like, which is superior in abrasion resistance and thermal conductivity, is used as the material for the substrate, the surface of the substrate on which the heat generating conductor layer is present, may be on the side opposite to the fixation nip N.

In order to reduce the amount of the bending stress to which the metallic sleeve 13 is subjected, the fixation nip side of the heater 11 may be incurvated so that its center portion, in terms of the recording medium conveyance direction, recesses toward the center of the metallic sleeve 13. With the provision of this structural arrangement, the fixing member would be further improved in durability.

c) Thermally Nonconductive Stay/holder 12

The thermally nonconductive stay/holder 12 plays the roles of supporting the heater 11, guiding the rotation of the metallic sleeve 13, and pressing the pressure roller 20, the role of a thermally insulating member for preventing heat from radiating in the direction opposite to the fixation nip N, or the like role. It is rigid, heat resistant, and thermally nonconductive. It is formed of liquid crystal polymer, phenol resin, PPS, PEEK, or the like.

d) Sleeve Edge Protection Member

The sleeve edge protection member 15 as a regulating member regulates the metallic sleeve 13 at the lengthwise (direction parallel to the generatrix of the metallic sleeve 13) edges. It is provided with a means for preventing the edge portions of the metallic sleeve 13 from being spread, that is, a means for reinforcing the edge portions of the metallic sleeve 13.

Figure 6:
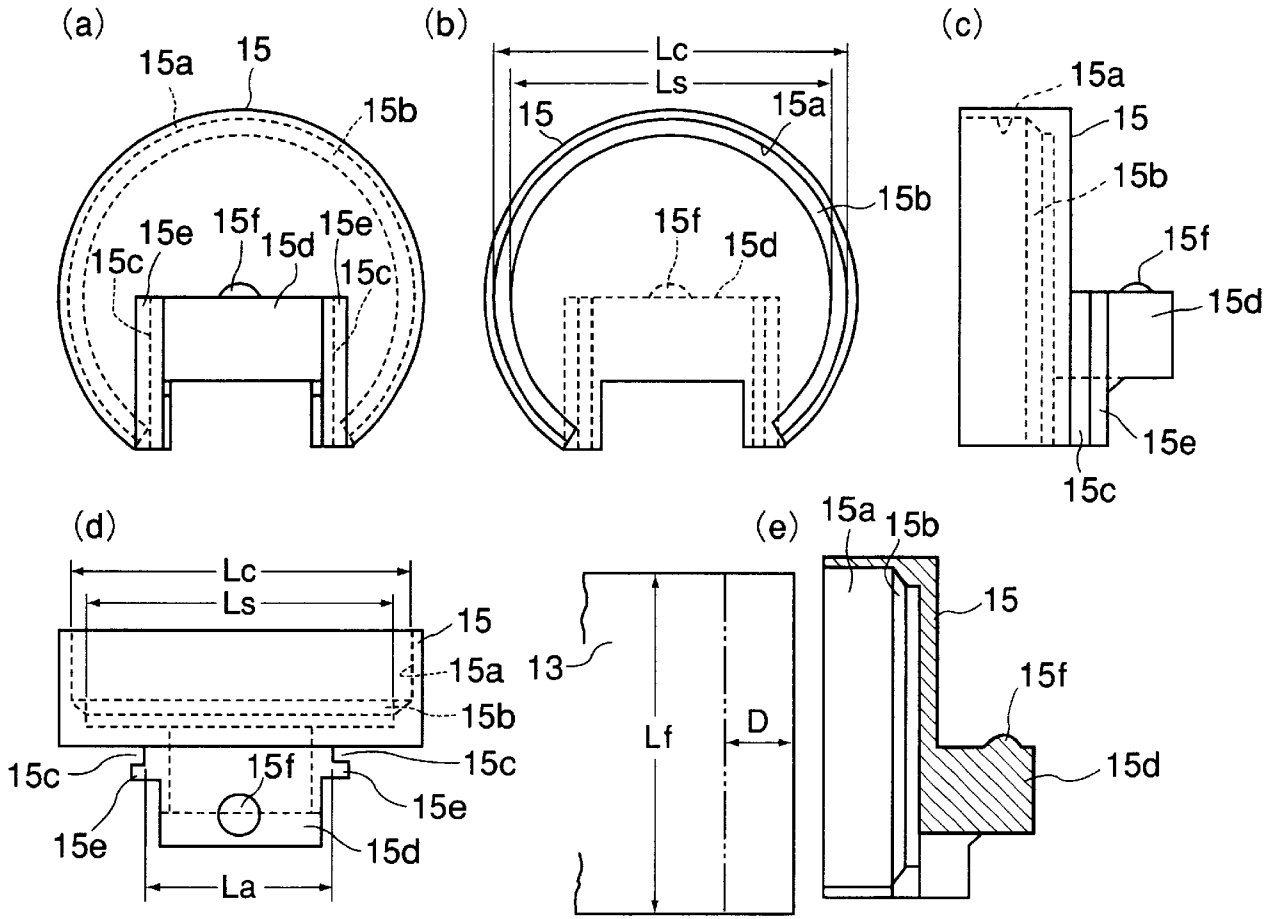
FIG. 6 is a drawing for showing the structure of the stationary protective cap.

The sleeve edge protection member 15 in this embodiment is in the form of a cap and is nonrotational; it is of a stationary type. In FIG. 6, (a) is an external view; (b) is an internal view; (c) is a side view; (d) is a plan view; and (e) is a sectional view.

Referring to FIG. 6(*e*), the metallic sleeve 13 has an external diameter of Lf. The portion of the peripheral surface of the metallic sleeve 13, adjacent to each lengthwise edge of the metallic sleeve 13, makes contact with the internal surface of the cylindrical portion of the protective cap 15. A referential code D stands for the width of this protective member contacting portion of the metallic sleeve 13.

The protective cap 15 is formed of a heat resistant substance such as PPS, liquid crystal polymer, phenol resin, or the like. It has a sleeve end confining portion 15*a,* which has an internal diameter of Lc, which is slightly greater than the external diameter Lf of the metallic sleeve 13. The aforementioned portion of the metallic sleeve 13 with the width of D fits in this sleeve end confining portion 15*a.* As the portion of the metallic sleeve 13 with the width of D, is inserted into the sleeve end confining portion 15*a* of the protective cap 15 with the internal diameter of Lc, the edge of the metallic sleeve 13 comes into contact with the sleeve catching portion 15*b* of the protective cap 15.

Figure 11:
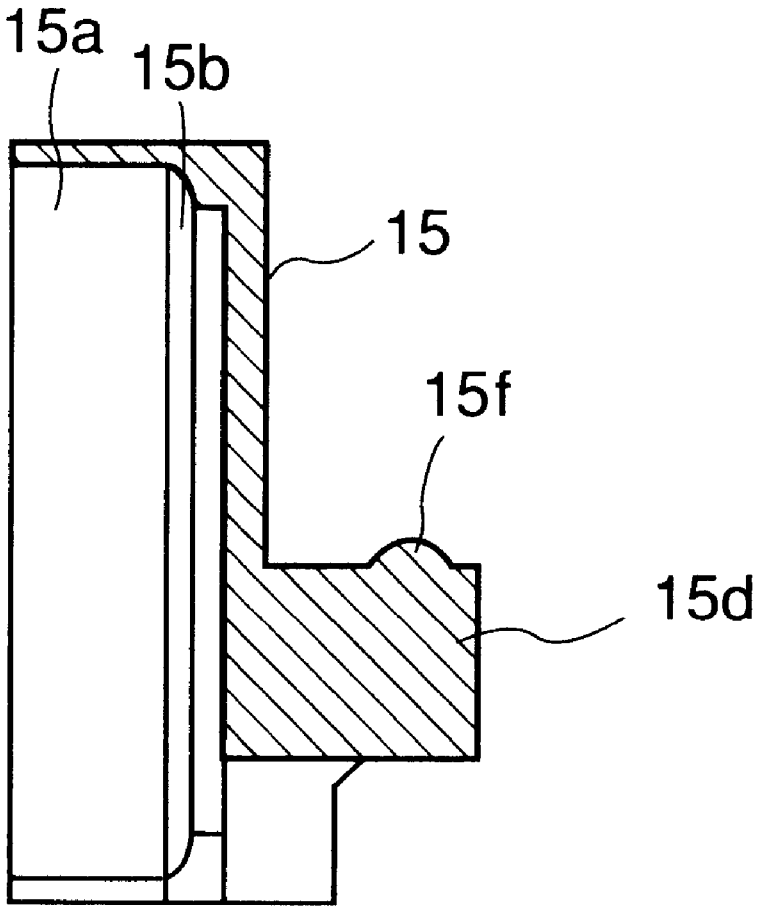
FIG. 11 is a sectional view of a protective cap, the internal surface which is given a curvature in terms of the thrust direction.

The sleeve catching portion 15*b* is tapered so that its internal diameter gradually reduces toward the outward side of the metallic sleeve 13 in terms of the lengthwise direction of the metallic sleeve 13. The internal diameter Ls of the outward edge of the sleeve catching portion, that is, the point at which the internal diameter of the sleeve catching portion is smallest, is sufficiently smaller than the external diameter Lf of the metallic sleeve 13. Incidentally, the internal surface of the sleeve catching portion 15*b* may be given such a curvature as shown in FIG. 11.

Figure 12:
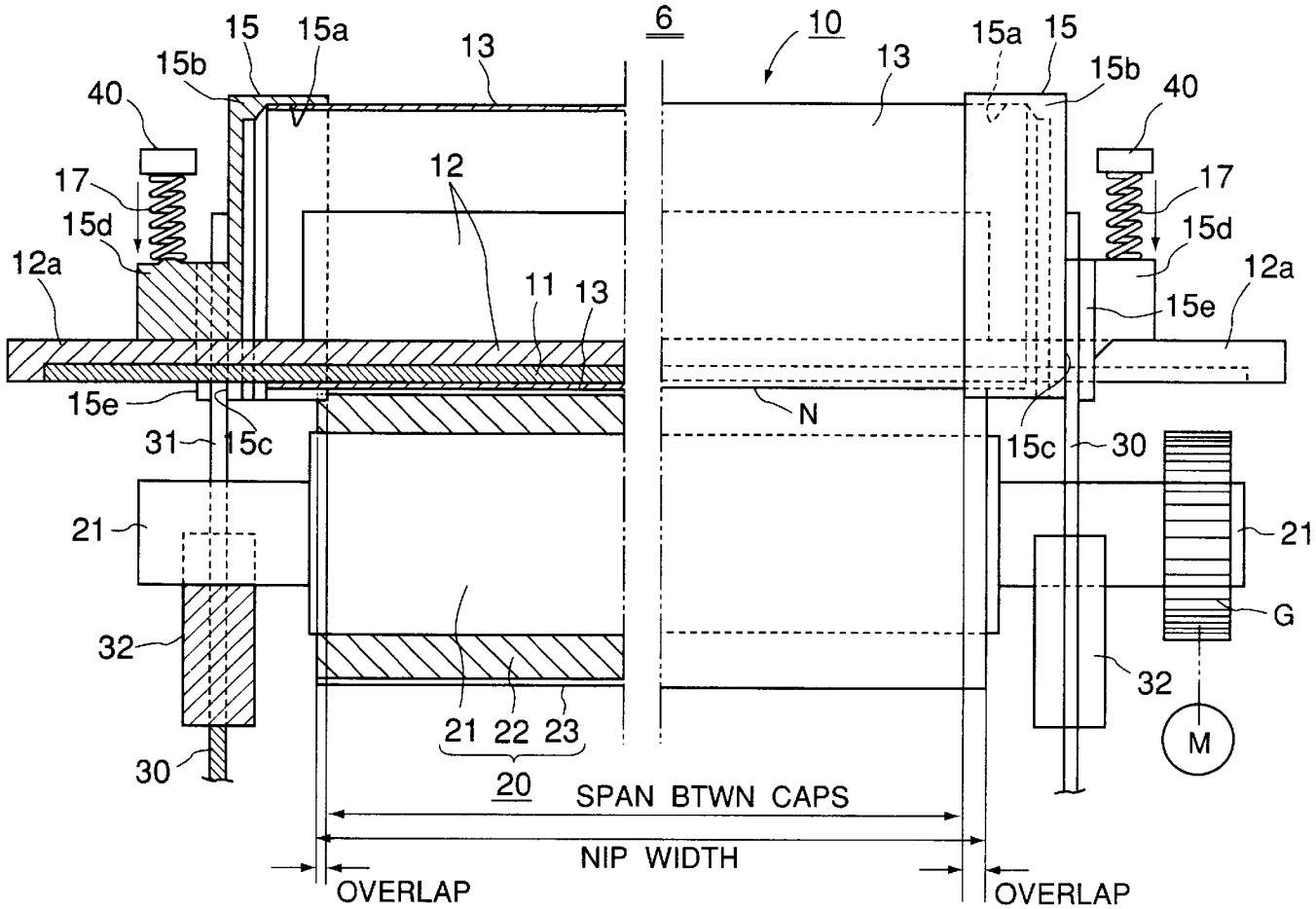
FIG. 12 is a sectional view of a thermal fixing apparatus, in which the lengthwise end portion of the fixation nip overlaps with the protective cap.

The lateral wall of the protective cap 15 is provided with a substantial gap, which faces the fixation nip N. It has two sections different in diameter: section with a diameter of Lc and section with a diameter of Ls which is smaller than Lc. This configuration in which the lateral wall is provided with the above described substantial gap facing the fixation nip N is suitable for a stationary protective cap 15, that is, a protective cap 15 which does not rotate in its circumferential direction. In other words, the aforementioned problem regarding the interference between the protective cap 15 and heater 11 can be easily solved by providing the lateral wall of the stationary protective cap 15 with a substantial gap which is proper in size and position. The provision of the gap allows the sleeve end confining portion 15*a* of the protective cap 15 to overlap with the lengthwise end portions of the fixation nip N (FIG. 12). Thus, the distance between the two protective cap 15 can be reduced, which makes it possible to reduce the dimension of a heating apparatus in terms of its lengthwise direction.

As for the means for immovably securing the protective cap 15, any means may be used as long as it immovably secure the protective cap 15. Incidentally, the spring seat portion 15*d* of the protective cap 15, which catches the pressure generated by the resiliency of the compression spring 17 may be independent from the protective cap 15.

The stationary type protective cap 15 has an anchoring portion 15*c* with a width of La, which is located between the protective portion 15*a* and a second regulating portion 15*e,* and is fitted in the recess of the wall 30 of the boxy frame of the apparatus. The spring seat portion 15*d* has a spring regulating portion 15*f,* which regulates the position of the compression spring 17 provided to generate a predetermined amount of contact pressure between the fixing member 10 and pressure roller 20.

The stationary protective cap 15 is provided with a substantial gap, the position of which corresponds to that of the fixation nip N. Further, the heater 11, and the heater supporting stay portion 12*a* (FIG. 3) of the thermally nonconductive stay/holder 12, are disposed in such a manner that they align with the substantial gap of the stationary protective cap 15, in terms of the direction perpendicular to the recording medium conveyance direction. Thus, the stationary protective cap 15 does not interfere with the heater 11, at the lengthwise ends of the heater 11.

Figure 5:
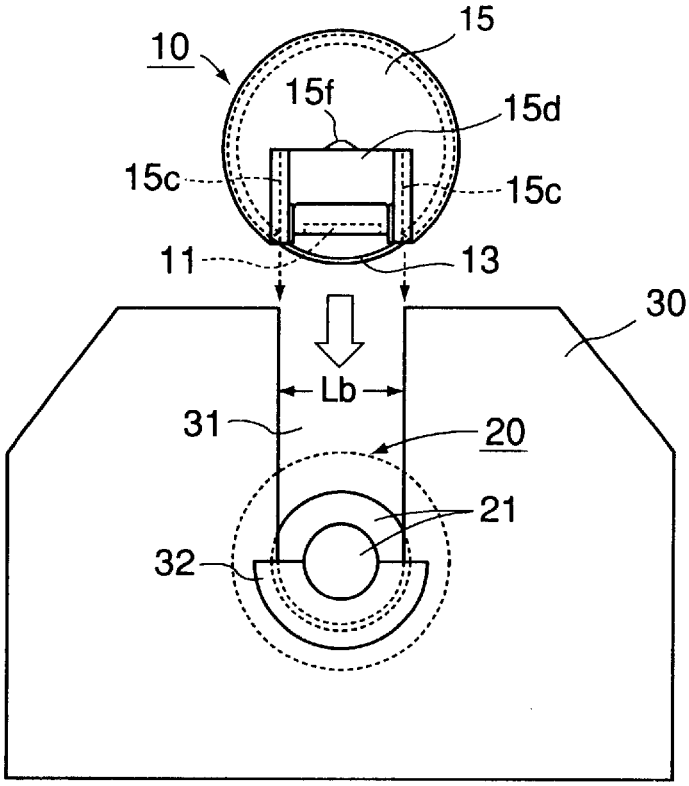
FIG. 5 is a schematic drawing for describing how the fixing member is mounted in the boxy frame of the fixing apparatus.

Referring to FIG. 5, the aforementioned anchoring portion 15*c* of the stationary protective cap 15 which constitutes the lengthwise end portion of the fixing member 10 is fitted in the recess 31 of the front (rear) wall 30 of the boxy frame of the fixing apparatus.

As a result, the fixing member 10 becomes supported by the front (rear) wall 30 of the boxy frame of the fixing apparatus. The width Lb of the recess of the front (rear) wall 30 of the boxy frame of the fixing apparatus is virtually the same as, or slightly greater than the width La of the anchoring portion 15*c* (FIG. 6(*d*)). Therefore, the anchoring portion 15*c* of the stationary protective cap 15 can be smoothly fitted in the recess of the front (rear) wall 30 of the boxy frame of the fixing apparatus. Therefore, the shifting of the protective cap 15 in the direction parallel to the thrust direction of the metallic sleeve 13 is prevented by the boxy frame of the fixing apparatus.

As a result, the shifting of the metallic sleeve 13 in its thrust direction is regulated by the pair of stationary protective caps 15.

Each protective cap 15 catches the metallic sleeve 13 by the peripheral surface and edge, with the portions 15*a* and 15*b,* confining the end portion of the metallic sleeve 13, with the internal surfaces of the portion 15*a* and 15*b,* preventing thereby the end portion of the metallic sleeve 13 from widening in the form of the end of a trumpet. Therefore, the metallic sleeve 13 is prevented from breaking at its lengthwise edges.

<Embodiment 2>

Figure 7:
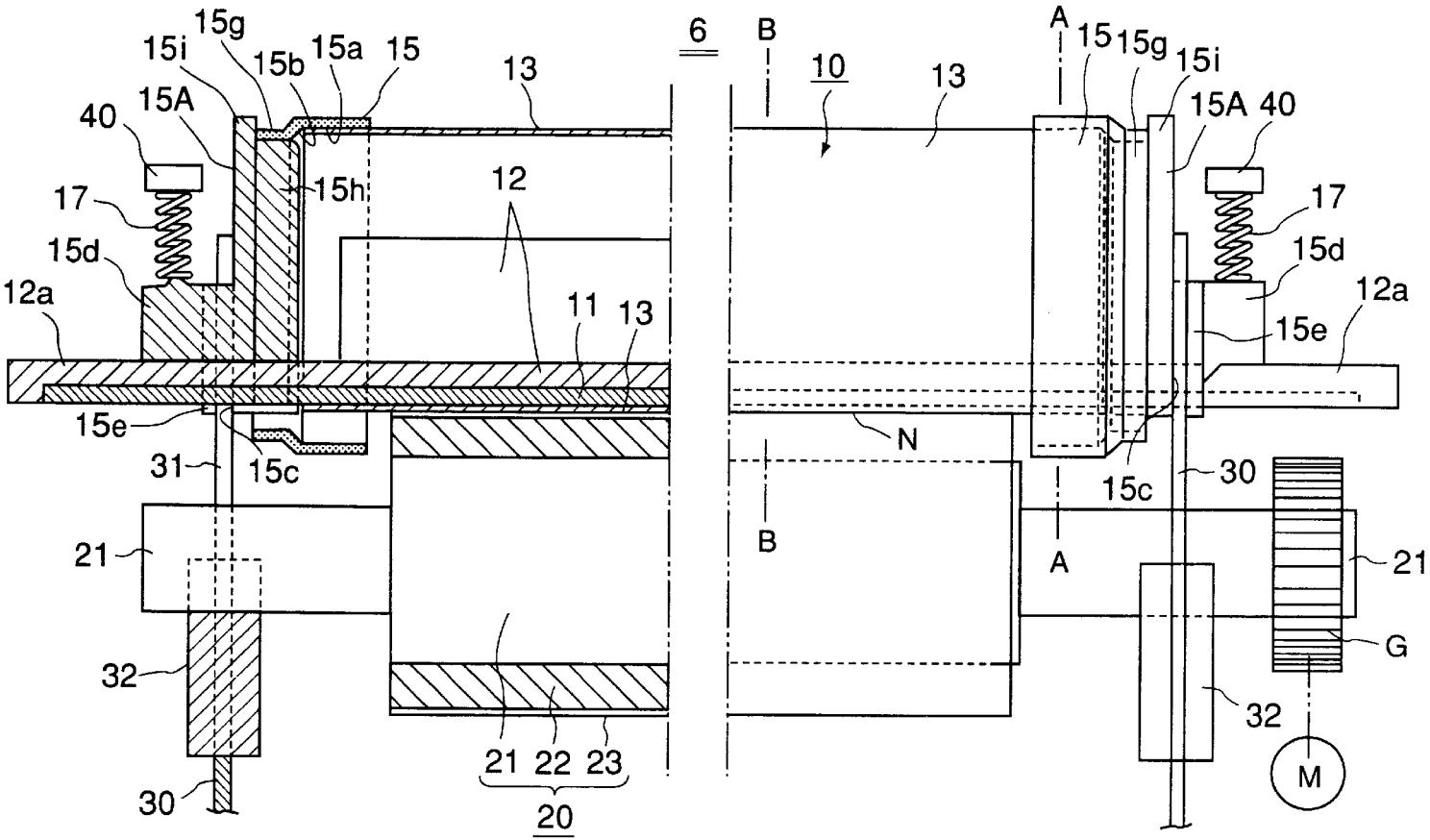
FIG. 7 is a schematic front view of the thermal fixing apparatus in the second embodiment of the present invention, in which certain portions have been intentionally left out to show the interior thereof.

In this embodiment, the sleeve end protection member as a regulating member is of a rotational type. FIG. 7 is a schematic front view of a thermal fixing apparatus 6, the sleeve end protection member of which is rotational. In the drawing, the portions of the fixing apparatus 6 nonessential to the description of this embodiment have been left out. The structural members and portions of the fixing apparatus 6 in FIG. 7, which are similar to those of the fixing apparatus in FIG. 1, are given the same referential codes as those in FIG. 1, to avoid the repetition of the same descriptions.

The sleeve end protection member 15 (first regulating member) for regulating the metallic sleeve 13 by the lengthwise edge is in the form of a wide ring. It is rotationally fitted around the inward portion, or the protective member supporting portion, of a sleeve end flange 15A (second regulating member).

Figure 8:
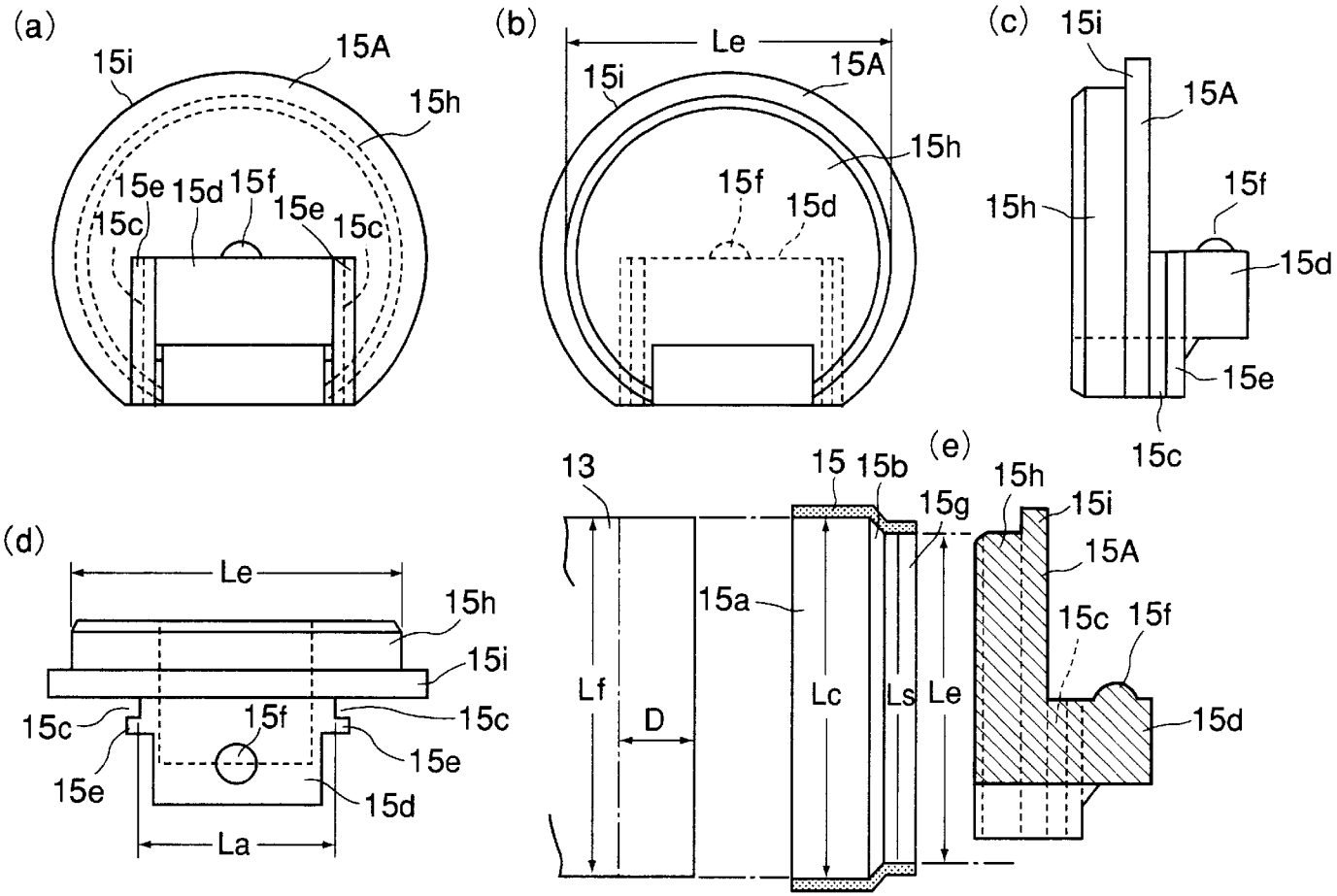
FIG. 8 is a drawing for showing the structure of the rotational protective ring.

FIG. 8(*a*), FIG. 8(*b*), FIG. 8(*c*), FIG. 8(*d*), and FIG. 8(*e*) are an external view, an internal view, a side view, a plan view; and a sectional view, respectively, of the combination of the sleeve end flange 15A and protective ring 15.

Referring to FIG. 8(*e*), the metallic sleeve 13 in this embodiment has an external diameter of Lf. The end portion of the peripheral surface of the metallic sleeve 13 contacts the internal surface of the rotational protective ring 15. This portion of the peripheral surface has a width of D in terms of the lengthwise direction of the metallic sleeve 13.

The rotational protective ring 15 is formed of a heat resistant substance such as PPS, liquid crystal polymer, phenol resin, or the like. It has a sleeve end confining portion 15*a,* which has an internal diameter of Lc, which is slightly greater than the external diameter Lf of the metallic sleeve 13. The aforementioned portion of the metallic sleeve 13 with the width of D fits in this sleeve end confining portion 15*a.* As the portion of the metallic sleeve 13 with the width of D is inserted into the sleeve end confining portion 15*a* of the rotational protective ring 15 with the internal diameter of Lc, the edge of the metallic sleeve 13 comes into contact with the sleeve catching portion 15*b* of the rotational protective ring 15. The sleeve catching portion 15*b* is tapered so that its internal diameter gradually reduces from the metallic sleeve side toward the outward side of the metallic sleeve 13 in terms of the lengthwise direction of the metallic sleeve 13. The internal diameter Ls of the outward edge of the sleeve catching portion, that is, the point at which the internal diameter of the sleeve catching portion 15*b* is smallest, is sufficiently smaller than the external diameter Lf of the metallic sleeve 13. In other words, the rotational protective ring 15 has two sections different in diameter: Section with a diameter of Lc and section with a diameter of Ls which is smaller than Lc. Incidentally, the internal surface of the sleeve catching portion 15*b* may be given such a curvature as shown in FIG. 11.

When the rotational protective ring 15 is employed in place Of the stationary protective cap 15 in the first embodiment, the rotational protective ring 15 is provided with a flange engaging portion 15*g,* which has the internal diameter of Ls, which is the same as that of the smallest internal diameter portion of the sleeve catching portion 15*b.* The sleeve end flange 15A is formed of the same heat resistant resin as the one used for the rotational protective ring 15. The sleeve end flange 15A comprises a rotational protective ring supporting portion 15*h* with a diameter of Le, which is smaller than the internal diameter Ls of the flange engaging portion 15*g* of the rotational protective ring 15. Thus, the flange engaging portion 15*g* of the sleeve end flange 15A can be loosely fitted around the rotational protective ring supporting portion 15*h* of the sleeve end flange 15A, being thereby rotationally supported by the sleeve end flange 15A. Further, the sleeve end flange 15A is provided with a regulating portion 15*i,* which regulates the shifting of the rotational protective ring 15 in its thrust direction.

The sleeve end flange 15A, around which the rotational protective ring 15 is loosely fitted, is provided with an anchoring portion 15*c* with a width of La, which is located between the regulating portion 15*i* and second regulating portion 15*e.* The spring seat portion 15*d* has a spring regulating portion 15*f,* which regulates the position of the compression spring 17 provided to generate a predetermined amount of contact pressure between the fixing member 10 and pressure roller 20.

The portion of the sleeve end flange 15A, which would interfere with the fixation nip N if the sleeve end flange 15A were virtually cylindrical, has been removed. Thus, the sleeve end flange 15A does not interfere with the heater 11, and the heater supporting stay 12*a* of the thermally nonconductive stay/holder 12, at their lengthwise ends.

The anchoring portion 15*c* of the sleeve end flange 15A, which constitutes the lengthwise end portion of the fixing member 10 is fitted in the recess 31 of the front (rear) wall 30 of the boxy frame of the fixing apparatus. As a result, the fixing member 10 becomes supported by the front (rear) wall 30 of the boxy frame of the fixing apparatus. Therefore, the shifting of the sleeve end flange 15A in the direction parallel to the thrust direction of the metallic sleeve 13 is prevented by the boxy frame of the fixing apparatus. As a result, the shifting of the metallic sleeve 13 in its thrust direction is regulated by the pair of sleeve end flanges 15A and the pair of rotational protective rings 15.

Figure 9:
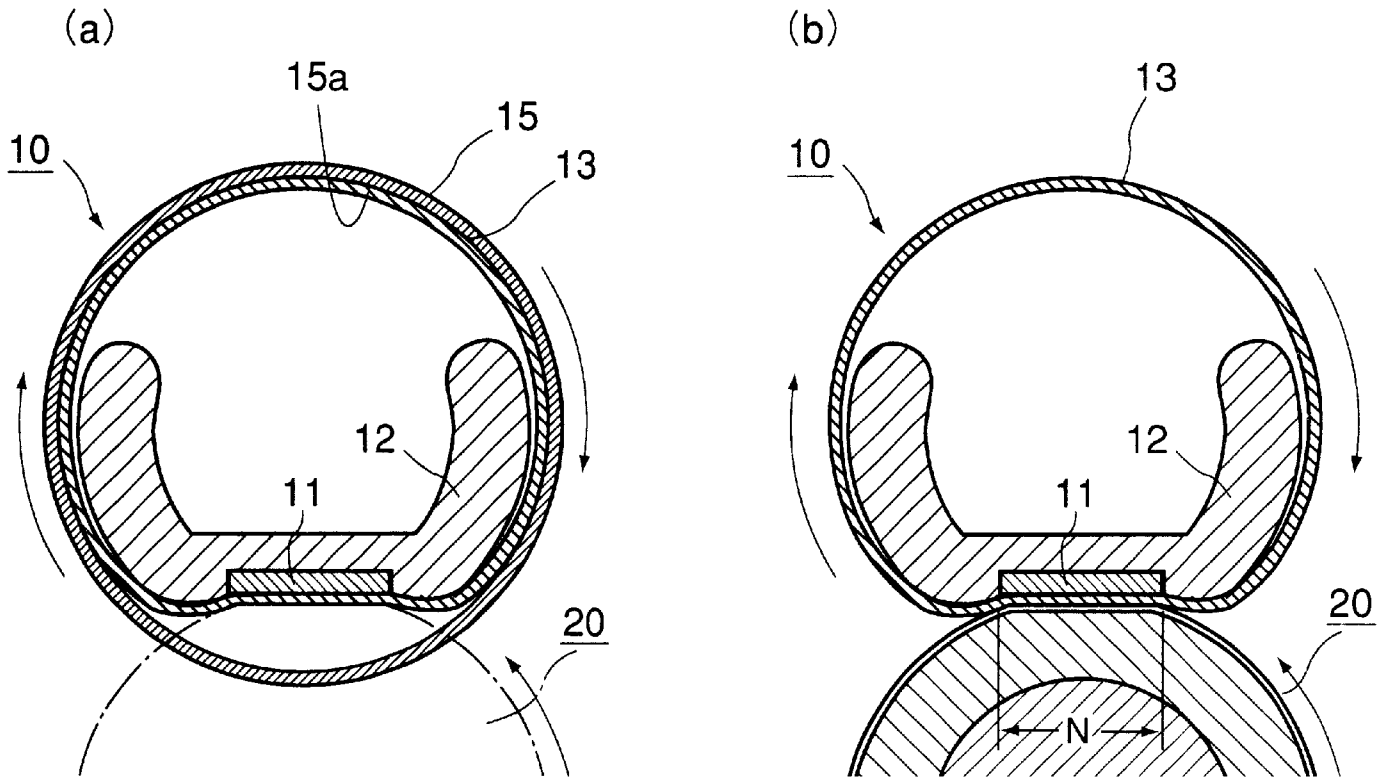
FIG. 9 is a sectional drawing for describing the behavior of the metallic sleeve.

Next, referring to FIGS. 9(*a*) and 9(*b*), the behaviors of the portions of the metallic sleeve 13 correspondent in position to the lengthwise center and edge portions of the fixing member 10, and the behaviors of the heater and the like, will be described with reference to the rotational protective ring 15. FIG. 9(*b*) is a sectional view of the heating apparatus, at the lengthwise center portion (plane B—B in FIG. 7) of the fixing member 10, and shows the relationship among the various components thereof. As a given portion of the metallic sleeve 13 in terms of the circumferential direction enters between the pressure roller 20 and heater 11, it is deformed in a manner to perfectly conform to the surface of the heater 11, by the compressive pressure which acts on the metallic sleeve 13, between the pressure roller 20 and heater 11, as shown in the drawing. The rest of the metallic sleeve 13, that is, the portion outside the fixation nip N, acts in a manner to keep the metallic sleeve 13 cylindrical.

Next, referring to FIG. 9(*a*), the behavior of the end portions of the metallic sleeve 13 outside the range of the pressure roller 20 (which is correspondent to the plane A—A in FIG. 7), in terms of the lengthwise direction, and the members in the adjacencies thereof, will be described. The metallic sleeve 13 is relatively high in rigidity. Therefore, as the lengthwise center portion of the metallic sleeve 13 deforms in a certain way, the lengthwise end portions of the metallic sleeve 13 deform in the same way. Thus, as a given center portion of the metallic sleeve 13 in terms of the circumferential direction enters the fixation nip N due to the rotation of the metallic sleeve 13, the portion of each lengthwise end portions of the metallic sleeve 13 correspondent in position to this portion in the fixation nip N, also deforms in the same way.

On the other hand, the portion of rotational protective ring 15 forms of resin, more specifically, the sleeve end confirming portion 15*a* of the rotational protective ring 15, the internal surface of which contacts a portion of the peripheral surface of the end portion of the metallic sleeve 13, in terms of the circumferential direction, remains cylindrical. Therefore, the portion of each lengthwise end portion of the metallic sleeve 13, correspondent in position to the portion of the metallic sleeve 13 in the fixation nip N, in terms of the circumferential direction, remains separated from the internal surface of the sleeve end confining portion 15*a* of the sleeve end flange 15A. Thus, the rotational protective ring 15 can be supported by the sleeve end flange 15A in such a manner that the rotational protective ring 15 holds a certain distance from the heater surface. With this arrangement, the rotational protective ring 15 does not interfere with the heater 11, and the heater supporting stay 12*a.*

The rotational protective ring 15 is rotationally supported by the sleeve end flange 15A. Therefore, the rotational protective ring 15 is made to rotate with the metallic sleeve 13 by the friction between a given range of the peripheral surface of the end portion of the metallic sleeve 13, in terms of the circumferential direction, and the portion of the internal surface of the sleeve end confining portion 15*a* which is in contact with this range of the metallic sleeve 13, and the friction between the edge of the metallic sleeve 13 and the internal surface of the sleeve edge catching portion 15*b* of the rotational protective ring 15. Thus, the elastically deformed portion of the metallic sleeve 13 never rubs against a stationary member, drastically prolonging the time it takes for the problems such as the tearing of the edge portion of the metallic sleeve 13 to occur.

<Embodiment 3>

A thermal fixing apparatus comprising a stationary sleeve protective member such as the protective cap in the first embodiment, and a thermal fixing apparatus comprising a rotational sleeve protective member such as the protective ring in the second embodiment, were evaluated in terms of fixing performance, startup speed, and durability.

The basic structural arrangement common among the actual thermal fixing apparatuses used in the tests is as follows: As for the heater 11, aluminum nitride was used as the material for the heater substrate. As for the heat generating conductor layer, a mixture of silver/palladium allay as a conductive component, phosphate glass as a matrix component, organic solvent, binder, dispersant, and the like, was printed on the heater substrate surface, on the side opposite to the fixation nip N, by screen printing, and then, was sintered at 400° C. The surface of the aluminum nitride substrate, on the fixation nip N side, was coated with a 10 $\mu$m thick protective layer of slippery glass, by screen printing.

The metallic sleeve 13 comprised a 50 $\mu$m thick stainless steel cylinder, as a base member, with an internal diameter of 30 mm, a 5 $\mu$m thick layer of primer, and a 10 $\mu$m thick layer of PFA resin coated on the prior layer by dipping. The external diameter of the finished metallic sleeve 13 was 30.13 mm.

The sleeve end protection members 17 were formed of liquid crystal polymer. The internal diameter of the portion of the protective member 17, which makes contact with the peripheral surface of the metallic sleeve 13 was 31.6 mm at where it was smallest. Two types of protective members 17 were prepared: stationary type (Test A), and rotational type (Test B) rotationally attached to the sleeve end flange.

As for the pressure roller 20, the peripheral surface of an aluminum core with a diameter of 20 mm was covered with a 5 mm thick layer of silicon rubber, and then, was wrapped with a tube of PFA as a surface layer.

In the tests, image forming apparatuses were adjusted so that the recording medium conveyance speed became 200 mm/sec.

In Comparative Test 1, a fixing film, such as the one described regarding the fixing apparatus in accordance with the prior arts, which had a polyimide film as the base layer, was used in place of the metallic sleeve 13. In order to ensure that the fixing film was satisfactory in terms of thermal conductivity, the fixing film was made using the following method: The 50 $\mu$m thick base layer was formed of polyimide containing BN filler by 30% in volume. This base layer was coated with a 5 $\mu$m thick primer layer. Then, a 10 $\mu$m thick layer of PFA resin was coated on the primer layer by dipping. The finished fixing film was virtually identical in shape and external diameter to the metallic sleeve 13. The shifting of the fixing film in its thrust direction was regulated using a method in accordance with the prior arts; it was regulated by the surface of a sleeve end flange, which was perpendicular to the lengthwise direction of the sleeve. As for the driving of the fixing film, the pressure roller was driven, and the fixing film was made to follow the rotation of the pressure roller.

In Comparative Test 2, the metallic sleeve 13 was used, and the shifting of the metallic sleeve 13 in its thrust direction was regulated using a method in accordance with the prior arts; it was regulated by the surface of a sleeve end flange, which was perpendicular to the lengthwise direction of the sleeve.

In order to verify the fixing apparatus performance, the fixing apparatuses were tested regarding the following aspects:

1) fixing performance: an unfixed toner image was formed on a recording medium, and the temperature at which the unfixed toner image could be satisfactorily fixed was measured while varying the heater temperature.
2) startup speed: the temperature of the fixing nip was measured three second after power began to be supplied to the heat generating conductive layer of the heater.
3) durability: the number of cut sheets of paper, as recording media, to which an unfixed toner image was satisfactorily fixed before the damages to the fixing film or metallic sleeve was confirmed, was counted.

The results of the tests were shown in Table 1.

TABLE 1

| | Required temp. | Nip temp. after 3 sec. | No. of sheets |
|---|---|---|---|
| EMB. A | 190° C. | 182° C. | 600,000–1,000,000 |
| EMB. B | 190° C. | 182° C. | ≧1,000,000 |
| COMP. EX. 1 | 213° C. | 169° C. | 500,000–700,000 |
| COMP. EX. 2 | 190° C. | 182° C. | 5,000–50,000 |

As is evident from the above table, with the employment of the metallic sleeve 13, which was superior in thermal conductivity to the fixing film formed of resin, the thermal efficiency could be drastically improved. The metallic sleeve 13 was superior to the resin fixing film also in startup speed, reducing the time it took before the first print was made.

Regarding the durability, compared to the fixing apparatus in Comparative Test 2, the fixing apparatus in Tests A and B, in which the metallic sleeve 13 superior in rigidity was used, and the shifting of the metallic sleeve 13 in its thrust direction was regulated by the protective member 17 in accordance with the present invention, was far superior in durability, for the following reason. That is, with the provision of the protective member 17 in accordance with the present invention, as the metallic sleeve 13 shifted in its thrust direction, each lengthwise end portion of the metallic sleeve 13 was caught with the internal surface of the sleeve end confining portion 15*a* of the protective member 17, by the peripheral surface, and each edge of the metallic sleeve 13 was caught by sleeve catching portion 15*b* of the protective member 17. Therefore, the load, which acted in the direction to widen the lengthwise end portion of the metallic sleeve 13 as the edge of the fixing film contacted the protective member 17, was cancelled by the sleeve end confining portion 15*a* and sleeve end catching portion 15*b* of the protective member 17.

As is evident from Comparative Tests 1 and 2, as the edge of the metallic sleeve higher in rigidity was caught by the flat surface of the sleeve end flange, which was perpendicular to the lengthwise direction of the sleeve, and the lengthwise end portion of the metallic sleeve was caught with the sleeve confining portion of the sleeve end flange, by the internal surface, the end portion of the metallic sleeve was subjected to such load that acted in the direction to expand the end portion. Thus, the metallic sleeve, which was higher in rigidity was less durable than the flexible resin fixing film.

In the case of Test B in which the protective ring in the second embodiment was rotationally attached to the sleeve end flange, the rotational protective ring 15 was caused to rotate following the rotation of the metallic sleeve (end portion). Therefore, it did not occur that the edge of the metallic sleeve was subjected to the large load generated by the friction between the edge of the metallic sleeve and the sleeve end flange in accordance with the prior arts. In other words, with the provision of the structural arrangement in the second embodiment, the edge of the metallic sleeve is far less likely to tear, drastically improving the durability of the metallic sleeve.

In the case of Test A in which the stationary protective cap was employed as a sleeve end protecting member, the stationary protective cap doubled as a sleeve end flange, making it possible to reduce the lengthwise dimension of the fixing apparatus. In other words, the employment of the protective cap in the first embodiment does not invite increase in the size of a thermal fixing apparatus.

<Embodiment 4>

Next, the fourth embodiment of the present invention will be described. The general structure of the image forming apparatus in this embodiment is the same as that in the first embodiment shown in FIG. 1. Further, the structure of the thermal fixing apparatus in this embodiment is the same as that in the second embodiment, in which the rotational protective ring was used as a sleeve end protecting member. Therefore, their descriptions will not be given here.

In this embodiment, the frictional resistance of the peripheral surface of the metallic sleeve was made greater across the end portions of the metallic sleeve which contact the rotational protective ring 15, than across the center portion which did not contact the rotational protective ring 15. As a result, the peripheral velocity at which the rotational protective ring 15 rotated following the rotation of the metallic sleeve 13 became much closer to the peripheral velocity at which the metallic sleeve 13 rotated. In other words, with this arrangement, it is possible to provide a highly durable high speed fixing apparatus.

More specifically, in this embodiment, the frictional resistance of the peripheral surface of the lengthwise end portions of the metallic sleeve 13, which had the width of D, that is, the end portions of the metallic sleeve 13, which were inserted into the sleeve end sleeve end confining portion 15*a,* was made greater than that of the lengthwise center portion of the metallic sleeve 13, which contacted the recording medium on which an unfixed toner image had been formed.

To described in more detail, the end portions of the metallic sleeve 13 having the width of D (in lengthwise direction) were not provided with the aforementioned releasing layer; only the center portion of the metallic sleeve 13 was provided with the releasing layer. In other words, across the lengthwise end portions, the base member of the metallic sleeve 13, or the primer layer, was left exposed; heat resistant fibers were planted; or heat resistant substance greater in frictional resistance than the releasing layer was painted or sprayed.

With the provision of the above described arrangement, as the metallic sleeve 13 rotated following the rotation of the pressure roller 20, the rotational protective ring 15 was rotated at a peripheral velocity far closer to the peripheral velocity of the metallic sleeve 13 than otherwise, due to the increase in the friction between the internal surface of the rotational protective ring 15, which contacted the peripheral surface of the metallic sleeve 13 due to the deformation of the metallic sleeve 13, and the peripheral surface of the metallic sleeve 13, at the lengthwise ends of the metallic sleeve 13.

In particular, when the friction coefficient $\mu$ between the peripheral surface of the metallic sleeve 13 and the internal surface of the rotational protective ring 15, and the friction coefficient $\mu'$ between the internal surface of the rotational protective ring 15, and the sleeve end flange 15A, satisfy the following relationship: $\mu >> \mu'$, in other words, the greater the difference between $\mu$ and $\mu'$, the closer to the peripheral velocity of the metallic sleeve 13 the peripheral velocity of the rotational protective ring 15.

In other words, with the provision of the above described arrangement, the friction between the edge of the metallic sleeve 13 and the sleeve end catching portion 15*b* of the rotational protective ring 15 is further reduced, improving therefore the durability of the metallic sleeve 13.

In order to confirm the above discovery, the following test was carried out. The apparatus used for this test was the same as the one used in the third embodiment, except that the surface condition of the lengthwise end portions was varied.

Evaluated in this test Were the ratio of the rotation of the rotational protective ring 15 to that of the metallic sleeve 13 (100% when two component are rotating at the same peripheral velocity), and the durability of the metallic sleeve 13 measured in terms of the number of copies successfully made before the damages began to appear at the edges of the metallic sleeve 13.

The results of the test are given in Table 2. The tested surface conditions of the lengthwise end portions of the metallic sleeve 13 were: when the bare surface of the metallic base member was exposed across the lengthwise end portions of the metallic sleeve 13; when the bare surface of the primer layer was exposed across the lengthwise end portions of the metallic sleeve 13; and when the lengthwise end portions of the metallic sleeve 13 were covered with the same releasing layer as the one covering the lengthwise center portion of the metallic sleeve 13. The friction coefficient between the rotational protective ring 15 and sleeve end flange 15A was kept at 0.3.

The friction coefficient in Table 2 represents the friction coefficient between the metallic sleeve 13 and the rotational protective ring 15.

TABLE 2

| | Bare metal | Bare primer | Releasing layer |
|---|---|---|---|
| Friction coefficient | 1.5 | 0.8 | 0.4 |
| Rotation ratio | 98% | 90% | 75% |
| No. of sheets | ≧3,000,000 | 2,500,000–3,000,000 | 1,000,000–1,500,000 |

As is evident from Table 2, the greater the difference between the friction between the lengthwise end portions of the metallic sleeve 13 and the rotational protective ring 15, and the friction between the rotational protective ring 15 and sleeve end flange 15A, the closer to the peripheral velocity of the metallic sleeve 13 the peripheral velocity of the rotational protective ring 15, and also the more durable the metallic sleeve 13.

<Embodiment 5>

Next, the fifth embodiment of the present invention will be described. The general structure of the image forming apparatus in this embodiment is the same as that in the first embodiment shown in FIG. 1. Further, the structure of the thermal fixing apparatus in this embodiment is the same as that in the second embodiment, in which the rotational protective ring was used as a sleeve end protecting member. In this embodiment, however, the measurement of the rotational protective ring in terms of the lengthwise direction of the metallic sleeve was reduced to prevent the increase in the apparatus size, while providing a means for making a highly thermally conductive metallic sleeve last for a long period of time.

Figure 10:
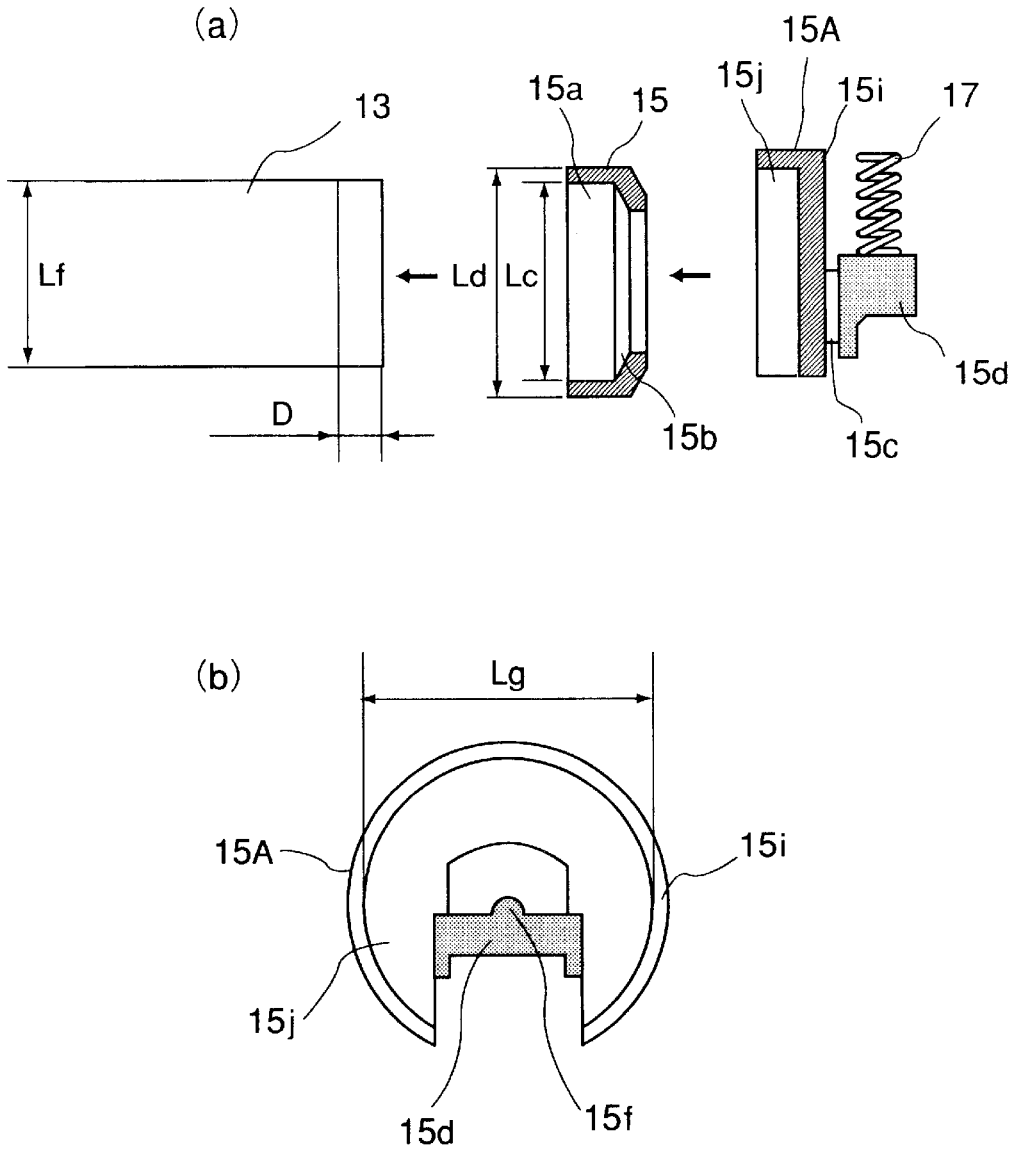
FIG. 10 is a drawing for showing the structure of the rotational protective ring in the fifth embodiment of the present invention.

Referring to FIG. 10(*a*), in this embodiment, the lengthwise end portion of the metallic sleeve, which has the width (in terms of the lengthwise direction of the metallic sleeve) of D, was caught by the internal surface of the sleeve end confining portion 15*a* of the rotational protective ring 15 with the internal diameter of Lc, as in the second embodiment. Further, the edge of the metallic sleeve 13 was caught by the sleeve end catching portion 15*b* of the rotational protective ring 15, the internal diameter of which gradually reduces toward the outward side of the apparatus, also as in the second embodiment.

The essential characteristic of this embodiment is how the rotational protective ring 15 is rotationally supported by the rotational protective ring supporting portion of the sleeve end flange 15A. Referring to FIGS. 10(*a*) and 10(*b*), the internal diameter Lg of the rotational protective ring supporting portion 15*j* of the sleeve end flange 15A is made the same as, or slightly greater than, the external diameter Ld of the rotational protective ring 15, and the rotational protective ring 15 is supported by the internal surface of the rotational protective ring supporting portion 15*j* of the sleeve end flange 15A, by the peripheral surface. In other words, the peripheral surface of the sleeve end confining portion 15*a* of the rotational protective ring 15, into which the lengthwise end portion of the metallic sleeve 13 with the width D is fitted, slides on the internal surface Of the rotational protective ring supporting portion 15*j* of the sleeve end flange 15A. Therefore, in terms of the lengthwise direction, the range, across which the rotational protective ring 15 contacts the metallic sleeve 13, overlaps with the range across which the rotational protective ring 15 contacts the sleeve end flange 15A. In other words, with the provision of this structural arrangement, it is possible to reduce the lengthwise measurement of the fixing apparatus, without causing the edge of the metallic sleeve 113, and the sleeve end flange 15A, to interfere with each other. Therefore, it is possible to prevent the problem that the edge of the metallic sleeve 13 cracks as it continuously rubs against the member for regulating the lengthwise shifting of the metallic sleeve 13, without inviting the increase in the size of a fixing apparatus.

Further, in order to allow the rotational protective ring 15 to more smoothly slides on the internal surface of the rotational protective ring supporting portion of the sleeve end flange 15A, lubricant such as grease or the like may be interposed between the external surface of the rotational protective ring 15 and the internal surface of the rotational protective ring supporting portion of the sleeve end flange 15A. Further, a bearing or the like may be interposed between the two surfaces in order to minimize the friction between the two surfaces so that the force which interferes with the rotation of the rotational protective ring 15 caused by the rotation of the metallic sleeve 13 is minimized.

With the provision of the above described structural arrangement, the amount of torque necessary to rotate the rotational protective ring 15 become smaller, allowing the rotational protective ring 15 to rotate more easily following the rotation of the metallic sleeve 13. Therefore, it is possible to provide a highly durable fixing apparatus.

As described above, according to an aspect of the present invention, a sleeve protecting cap is disposed at at least one of the lengthwise end of a metallic sleeve. The protective cap catches the end portion the metallic sleeve with its internal surface, by the peripheral surface as well as the edge, confining the lengthwise end portion of the metallic sleeve 13. Therefore, the length wise end portion of the metallic sleeve 13 is prevented from widening like the end of a trumpet.

Therefore, the metallic sleeve 13 is prevented from breaking from the edge.

According to another aspect of the present invention, a sleeve protecting ring is rotationally attached to a sleeve end flange. This rotational protective ring is rotatable relative to a metallic sleeve. The portion of the protective ring, which catches the metallic sleeve by the edge in terms of the thrust direction, is tapered so that its internal diameter gradually reduces toward the lengthwise end of the apparatus. The portion of the rotational protective ring, on the metallic sleeve side, is structured so that the peripheral surface of the lengthwise end portion of the metallic sleeve contacts the internal surface of this portion of the rotational protective ring. With the provision of the above described structural arrangement, the rotational protective ring does not interfere with the heater surface, for the following reason. That is, as a given portion of the metallic sleeve, in terms of the circumferential direction, enters between the heater and pressure roller, the this portion of the metallic sleeve is deformed in a manner to conform to the surface of the heater, perfectly contacting the surface of the heater. As a result, the portion of the lengthwise end portion of the metallic sleeve, correspondent in the circumferential direction to the portion of the metallic sleeve between the heater and pressure roller, becomes separated from the internal surface of the rotational protective ring. Consequently, the portion of the lengthwise end portion of the metallic sleeve other than the portion correspondent to the portion between the heater and pressure roller is placed perfectly in contact with the internal surface of the rotational protective ring, by the deformation of the metallic sleeve, with no interference between the rotational protective ring and heater surface. Therefore, the rotational protective ring rotates following the rotation of the metallic sleeve, preventing the problem that the edge Of the metallic sleeve cracks as it continuously rubs against the member for regulating the shifting of the metallic sleeve in its lengthwise direction. In other words, according to this second aspect of the present invention, it is possible to provide a highly durable fixing system, in which heat is efficiently conducted to the recording medium being conveyed through the fixation nip after the formation of an unfixed toner image on the recording medium, and in which the problem that the metallic sleeve is damaged at its edges does not occur for a long period of time. Further, the rotational protective ring is prevented by the sleeve end flange fixed to the boxy frame of the fixing apparatus, from shifting in the thrust direction, preventing therefore the metallic sleeve, the shifting of which in the thrust direction is regulated by the rotational protective ring, from shifting relative to the boxy frame of the apparatus, in the thrust direction.

According to another aspect of the present invention, the sleeve edge protective member is structured so that the lengthwise end portion of the metallic sleeve contacts the internal surface of the rotational protective ring, and the rotational protective ring contacts the sleeve end flange by the peripheral surface, reducing therefore the measurement of the apparatus in terms of the lengthwise direction. Thus, it is possible to make a fixing apparatus highly durable without increasing its size, making it possible to realize a compact and durable fixing apparatus.

Further, in order to make the friction resistance of the peripheral surface of the lengthwise end portion of the metallic sleeve greater than that of the peripheral surface of the lengthwise center portion of the metallic sleeve, the peripheral surface of the lengthwise end portion of the metallic sleeve is roughened; the releasing layer is not formed across the lengthwise end portion of the metallic sleeve; or the lengthwise end portion of the metallic sleeve is coated with a substance high in frictional resistance than the releasing layer. With this arrangement, it is possible to cause the rotational protective ring fitted around the lengthwise end portion of the metallic sleeve, to rotates at a peripheral velocity much closer to the peripheral velocity at which the metallic sleeve rotates, reducing the amount of the friction between the lengthwise end portion of the metallic sleeve and the sleeve end catching portion of the rotational protective ring. Therefore, it is possible to realize a far more durable fixing system.

<Miscellanies>

1) A structural arrangement may be made to cause the metallic sleeve 13 to shift only in one direction so that the stationary sleeve edge protection cap 15, or sleeve edge protection ring 15, needs to be disposed at only one lengthwise edge of the metallic sleeve, that is, the edge toward which the metallic sleeve shifts.
2) The heater 11 may be replaced with an electromagnetic induction based heating member, for example, an iron piece or the like, in which heat is electromagnetically generated by the function of the magnetic field generated by an exciter coil assembly. Also, a metallic sleeve, through the entirety of which heat can be generated by electromagnetic induction, may be employed, as a heating/fixing film, by an image fixing apparatus.
3) Not only is a heating apparatus in accordance with the present invention usable as a thermal image fixing apparatus, but also usable as an image heating apparatus for improving the surface properties, such as glossiness, by heating a recording medium bearing an image, an image heating apparatus for temporarily fixing an image, a heating apparatus through which an object in the form of a sheet is conveyed to be dried, laminated, or pressed for wrinkle removal, a heating apparatus for drying an ink image in an ink jet printer or the like, or the like heating apparatus, which is obvious.

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus comprising:

a rotatable member contactable to a recording material carrying an image;

a regulating member for regulating a movement of said rotatable member in the direction of a generating line of said rotatable member;

wherein said regulating member is fixed so as not to rotate and has a surface opposed to an outer peripheral surface of an end portion of said rotatable member.

2. An apparatus according to claim 1, further comprising a roller for forming a nip with said rotatable member to nip the recording material.

3. An apparatus according to claim 2, wherein said rotatable member is flexible, and said rotatable member is deformed when said nip is formed.

4. An apparatus according to claim 3, wherein when said nip is formed, the outer peripheral surface of said rotatable member has a region in which said outer peripheral surface is contacted to the opposed surface of said regulating member and a region in which said outer peripheral surface is spaced from the opposed surface.

5. An apparatus according to claim 2, wherein the opposed surface of said regulating member is accurate along a circumference of said rotatable member.

6. An apparatus according to claim 5, wherein said regulating member is cut away at a portion responding to said nip.

7. An apparatus according to claim 6, wherein the opposed surface of said regulating member overlaps with a region of the nip in the longitudinal direction of said roller.

8. An apparatus according to claim 1, further comprising a heater and a holder supporting said heater, wherein said regulating member is fixed on said holder.

9. An apparatus according to claim 8, wherein said holder has a function of the leading rotation of said rotatable member.

10. An apparatus according to claim 2, wherein a diameter of the opposed surface is larger than the diameter of the outer peripheral surface of said rotatable member.

11. An apparatus according to claim 1, wherein said regulating member has a second surface for receiving an end surface of said rotatable member, and an angle formed between the opposed surface and the second surface is larger than 90°.

12. An apparatus according to claim 1, wherein said regulating member has a second surface for receiving an end surface of said rotatable member, and said second surface is curved.

13. An apparatus according to claim 1, wherein said regulating member is made of heat resistive resin material.

14. An apparatus according to claim 1, wherein said rotatable member has a metal layer.

15. An apparatus according to claim 14, further comprising a coil for generating a magnetic field for inducing eddy currents in said metal layer, wherein an image on the recording material is heated by heat from said metal layer generating heat by the eddy currents.

16. An apparatus according to claim 1, further comprising a heater contacted to an inner surface of said rotatable member, and the image on the recording material is heated by heat from said heater through said rotatable member.

17. An image heating apparatus comprising:

a rotatable member contactable to a recording material carrying an image;

a first regulating member for regulating a moment of said rotatable member in a direction of a generating line of said rotatable member;

wherein said first regulating member is rotationally driven by said rotatable member;

a second regulating member for regulating a movement of said first regulating member in the direction of the generating line, said second regulating member being fixed so as not to rotate;

wherein said first regulating member has a surface opposed to an outer peripheral surface at an end portion with respect to the direction of the generating line of said rotatable member; and wherein said first regulating member is in the form of a ring extending along an endless path, and said second regulating member is circular having ends in its circumferential direction, provided by a cut away portion.

18. An apparatus according to claim 17, further comprising a roller for forming a nip with said rotatable member to nip the recording material.

19. An apparatus according to claim 18, wherein said rotatable member is flexible, and said rotatable member is deformed when said nip is formed.

20. An apparatus according to claim 19, wherein when said nip is formed, the outer peripheral surface of said rotatable member has a region in which said outer peripheral surface is contacted to the opposed surface of said first regulating member and a region in which said outer peripheral surface is spaced from the opposed surface.

21. An apparatus according to claim 20, wherein said first regulating member rotates with said rotatable member by frictional force in the contact region with said rotatable member.

22. An apparatus according to claim 21, wherein a friction coefficient of the outer peripheral surface of said rotatable member in the contact region is higher than a friction coefficient in a region where it passes by the nip.

23. An apparatus according to claim 17, wherein the opposed surface of said first regulating member is accurate along a circumference of said rotatable member.

24. An apparatus according to claim 17, wherein said second regulating member is cut away at a portion responding to said nip.

25. An apparatus according to claim 18, wherein said second regulating member is fixed on a frame rotatably supporting said roller.

26. An apparatus according to claim 18, wherein a diameter of the opposed surface is larger than the diameter of the outer peripheral surface of said rotatable member.

27. An apparatus according to claim 18, wherein said first regulating member has a second surface for receiving an end surface of said rotatable member, and an angle formed between the opposed surface and the second surface is larger than 90°.

28. An apparatus according to claim 18, wherein said first regulating member has a second surface for receiving an end surface of said rotatable member, and said second surface is curved.

29. An apparatus according to claim 17, wherein said regulating member is made of heat resistive resin material.

30. An apparatus according to claim 29, wherein said rotatable member has a metal layer.

31. An apparatus according to claim 30, further comprising a coil for generating a magnetic field for inducing eddy currents in said metal layer, wherein an image on the recording material is heated by heat from said metal layer generating heat by the eddy currents.

32. An apparatus according to claim 17, further comprising a heater contacted to an inner surface of said rotatable member, and the image on the recording material is heated by heat from said heater through said rotatable member.

* * * * *

UNITED STATES PATENT AND TRADEMARK OFFICE

CERTIFICATE OF CORRECTION

PATENT NO. : 6,671,488 B2
DATED : December 30, 2003
INVENTOR(S) : Satoru Izawa et al.

It is certified that error appears in the above-identified patent and that said Letters Patent is hereby corrected as shown below:

Column 6,
Line 5, “fitted” should read -- fitted with --.

Column 7,
Line 63, “formed” should read -- form --.

Column 8,
Line 7, “b) heater 1” should read -- b) heater 11 --.

Column 9,
Line 64, “cap” should read -- caps --.

Column 10,
Line 3, “secure” should read -- secures --.

Column 13,
Line 27, “allqy” should read -- alloy --.

Column 14,
Line 20, “second” should read -- seconds --.

Column 15,
Line 51, “sleeve end” (2nd occurrence) should be deleted.

Column 16,
Line 30, “component” should read -- components --.

Column 17,
Line 59, “slides” should read -- slide --.

Column 18,
Line 11, “portion” should read -- portion of --.
Line 14, “length wise” should read -- lengthwise --.
Line 35, “the this” should read -- this --.

UNITED STATES PATENT AND TRADEMARK OFFICE

CERTIFICATE OF CORRECTION

PATENT NO. : 6,671,488 B2
DATED : December 30, 2003
INVENTOR(S) : Satoru Izawa et al.

It is certified that error appears in the above-identified patent and that said Letters Patent is hereby corrected as shown below:

Column 19,
Line 21, "rotates" should read -- rotate --.

Signed and Sealed this

Eighth Day of June, 2004

JON W. DUDAS
*Acting Director of the United States Patent and Trademark Office*